US011358746B2

(12) United States Patent
Davis

(10) Patent No.: US 11,358,746 B2
(45) Date of Patent: Jun. 14, 2022

(54) RAZOR BLADE HOLDER ASSEMBLY FOR A POUCH MACHINE

(71) Applicant: Winpak Lane, Inc., San Bernardino, CA (US)

(72) Inventor: Steven Davis, San Bernardino, CA (US)

(73) Assignee: WINPAK LANE, INC, Rialto, CA (US)

( * ) Notice: Subject to any disclaimer, the term of this patent is extended or adjusted under 35 U.S.C. 154(b) by 245 days.

(21) Appl. No.: 16/850,382

(22) Filed: Apr. 16, 2020

(65) Prior Publication Data

US 2021/0323710 A1 Oct. 21, 2021

(51) Int. Cl.
*B65B 61/06* (2006.01)
*B65B 9/10* (2006.01)

(52) U.S. Cl.
CPC ..... *B65B 61/06* (2013.01); *B65B 9/10* (2013.01)

(58) Field of Classification Search
CPC ..... B65B 61/06; B65B 9/10; B26D 3/001; B26D 2003/286; B26B 5/003; Y10T 83/9461
USPC ..... 53/436; 83/698.11–699.61
See application file for complete search history.

(56) References Cited

U.S. PATENT DOCUMENTS 3,705,526 A * 12/1972 Bishop ..... B26D 7/2614 83/698.31
4,252,163 A * 2/1981 Onda ..... B27C 1/002 144/130
4,422,359 A * 12/1983 Leboeuf ..... B26D 5/02 83/546
4,932,301 A * 6/1990 Buck ..... B26D 7/2614 83/640
5,224,408 A * 7/1993 Steidinger ..... B26D 7/2614 83/346
5,282,409 A * 2/1994 Rojas ..... B26D 7/2614 83/348
5,357,836 A * 10/1994 Stromberg ..... B26D 7/2614 83/343

* cited by examiner

*Primary Examiner* — Anna K Kinsaul
*Assistant Examiner* — Himchan Song
(74) *Attorney, Agent, or Firm* — The Watson IP Group, PLC; Jovan N. Jovanovic

(57) ABSTRACT

A razor blade holder assembly having a body, a movable jaw and an adjustment member. The body has a fixed jaw with a support face and an adjustor channel. The movable jaw assembly has a plate member and a releasable securement subassembly. The plate member is over the adjustor channel and the support face. The releasable securement subassembly couples the plate member to the body and applies a biasing force against the plate member toward the support face. The adjustment member has an elongated rod member rotatably within the adjustor channel, a forcing surface is selectively rotatable into the plate member to direct the plate member away from the support face. In a clamped configuration, the plate member clamps a razor blade. In an open configuration, the forcing surface of the elongated rod member overcomes the biasing member to separate the plate member from the support face.

18 Claims, 16 Drawing Sheets

RAZOR BLADE HOLDER ASSEMBLY FOR A POUCH MACHINE

CROSS-REFERENCE TO RELATED APPLICATION

N/A

BACKGROUND OF THE DISCLOSURE

1. Field of the Disclosure

The disclosure relates in general to apparatuses for use in association with packaging equipment, and more particularly, to a razor blade holder assembly, a razor blade holder assembly holding a razor blade as well as a pouch machine or other packaging equipment having a razor blade holder assembly holding a razor blade.

2. Background Art

It is well known that certain package forming and/or filling machines and other equipment rely on cutting film and/or webs of material to properly size the film or to trim package size. While not limited thereto, one such type of filling machine is a form, fill, seal pouch machine, wherein, for example, multiple side by side pouches are simultaneously formed and filled with a flowable material (such as sauce, syrup, condiments, among others). It is necessary to separate adjoining webs of pouches as they proceed through the machine. This is typically accomplished through the use of cutting blades (such as razor blades) that are mounted to the machine and which extend into the path travelled by the film. As the film contacts the razor blades, the blades cut the film.

Over time, such blades become dull or may be otherwise damaged or impaired. Every so often it becomes necessary to replace these razor blades. Typically, the razor blades are clamped between two jaws through the use of fasteners. The fasteners are loosened to remove one of the jaws and the blade can then be removed. Problematically, due to the location of the blades in the machines, and the limited access thereto, coupled with a protruding razorblade and the requirement for wrenches and/or sockets, injury can result. For example, it is not uncommon to have an operator cut by the razor blade, even when the blade has been utilized and in need of replacement. For example, in the prior art, such as the prior art holder shown in FIGS. 1 and 2, the length of the blade is exposed, and, a bolt must be removed in order to facilitate the removal of the blade from between the two clamping jaws.

SUMMARY OF THE DISCLOSURE

The disclosure is directed a razor blade holder assembly comprising a body, a movable jaw and an adjustment plate. The body has a frame attachment and a fixed jaw. The fixed jaw has a support face and an adjustor channel extending thereacross. The movable jaw assembly includes a plate member and a releasable securement subassembly. The plate member has an inner surface placeable over the adjustor channel and the support face. The releasable securement subassembly couples the plate member to the body. The releasable securement subassembly includes a biasing member that applies a biasing force against the plate member, biasing the plate member toward the support face. The adjustment member includes an elongated rod member rotatably positionable within the adjustor channel. The elongated rod member has a forcing surface selectively rotatable into the plate member to, in turn, overcome the biasing member to direct the plate member away from the support face. In a clamped configuration, the plate member is directed into the support face to be structurally configured to clamp a razor blade therebetween. In an open configuration, the forcing surface of the elongated rod member overcomes the biasing member to separate the plate member from the support face to be structurally configured to facilitate the removal of the razor blade therebetween.

In some configurations, the body further includes an adjustor bore aligned with the adjustor channel, through which the elongated rod member can be directed.

In some configurations, the adjustor channel is substantially parallel to a cutting edge of a razor blade.

In some configurations, the fixed jaw further includes a blade interface extending from the surface thereof. The blade interface is structurally configured to interact with the razor blade to position the razor blade in a desired orientation on the support face.

In some configurations, the blade interface comprises at least one post extending from the support face.

In some configurations, the plate member includes a first portion and a second portion. The first and second portions are angled relative to each other to form an outwardly concave configuration. The first portion has a distal edge structurally configured to overlie the razor blade and the support face and to impart a force thereagainst.

In some configurations, the biasing member comprises an elastomer that overlies an outer surface of the plate member over the second portion of the plate member, with a fastener that couples the elastomer and the plate member to the body, with the elastomer and the body sandwiching the plate member therebetween.

In some configurations, the adjustor channel is positioned between the distal edge of the movable jaw assembly and the biasing member.

In some configurations, the plate member includes a first portion and a second portion. The first portion has an inner surface directable toward the support face, to, in turn, retain a razor blade therebetween.

In some configurations, the elongated rod member further includes a clamped facing surface and an open facing surface. The clamped facing surface faces the plate member when in a clamped configuration. The open facing surface faces the plate member when in the open configuration. The forcing surface is positioned rotationally between the clamped facing surface and the open facing surface.

In some configurations, the elongated rod member is rotatable about an axis of rotation between a clamped configuration and an open configuration.

In some configurations, the elongated rod member further includes a handle member to facilitate the rotation thereof. At least a portion of the handle member is stowable within a grasping channel in the body when the elongated rod member is in the clamped configuration.

In some configurations, the elongated rod member is releasably attachable to the body and removable when rotated into a clamped configuration.

In some configurations, the elongated rod member includes an end cap portion interfaceable with the plate member when in the clamped configuration, to, in turn, preclude slidable removal of the elongated rod member from within the adjustor channel.

In another aspect of the disclosure, the disclosure is directed to a combination razor blade holder assembly and razor blade. In such a configuration, the razor blade has a first side and a second side, and a cutting edge. The first side of the razor blade is positioned over the support face. In such a configuration, in a clamped configuration, the plate member is directed into the support face to be structurally configured to impart force against the second side of the razor blade to clamp the razor blade therebetween. In an open configuration, the forcing surface of the elongated rod member overcomes the biasing member to separate the plate member from the support face to be structurally configured to facilitate the removal of the razor blade therebetween.

In some configurations, a portion of the cutting edge of the razor blade extends beyond the footprint of the support face.

In some configurations, a portion of the cutting edge of the razor blade remains within the footprint of the support face.

In another aspect of the disclosure, the disclosure is directed to a pouch machine having a frame with at least one razor blade holder assembly of the type described herein that is coupled thereto and that retains a razor blade.

BRIEF DESCRIPTION OF THE DRAWINGS

The disclosure will now be described with reference to the drawings wherein.

DETAILED DESCRIPTION OF THE DISCLOSURE

Figure 1:
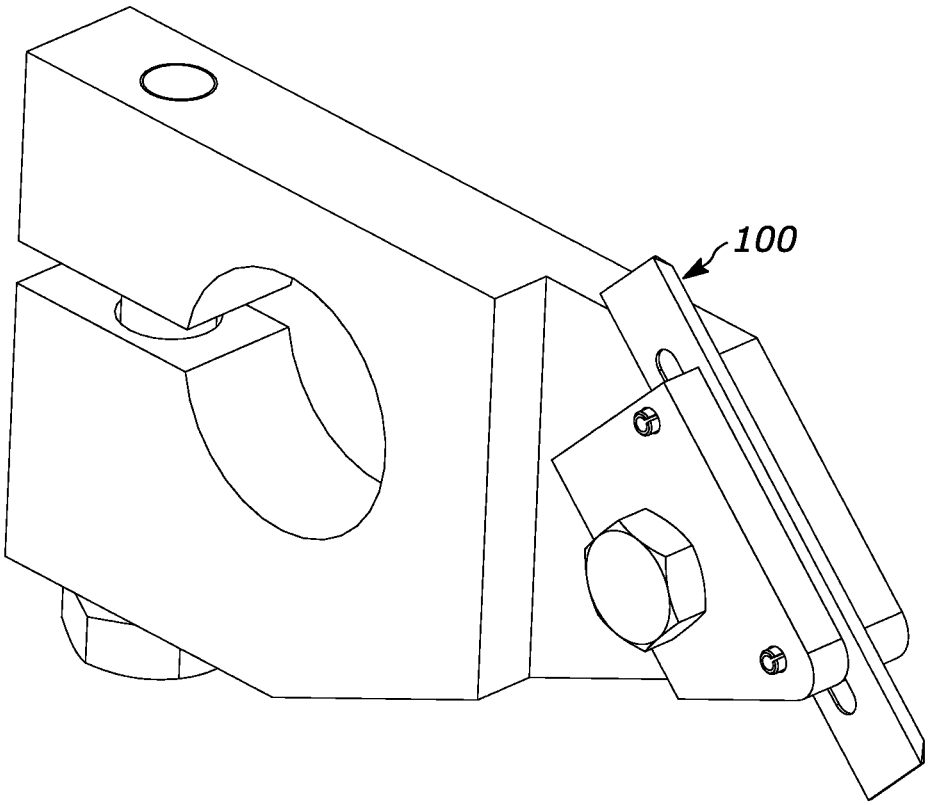
(PRIOR ART) FIGURE 1
FIG. 1 of the drawings is a front perspective view of a prior art razor blade holder assembly.
Figure 2:
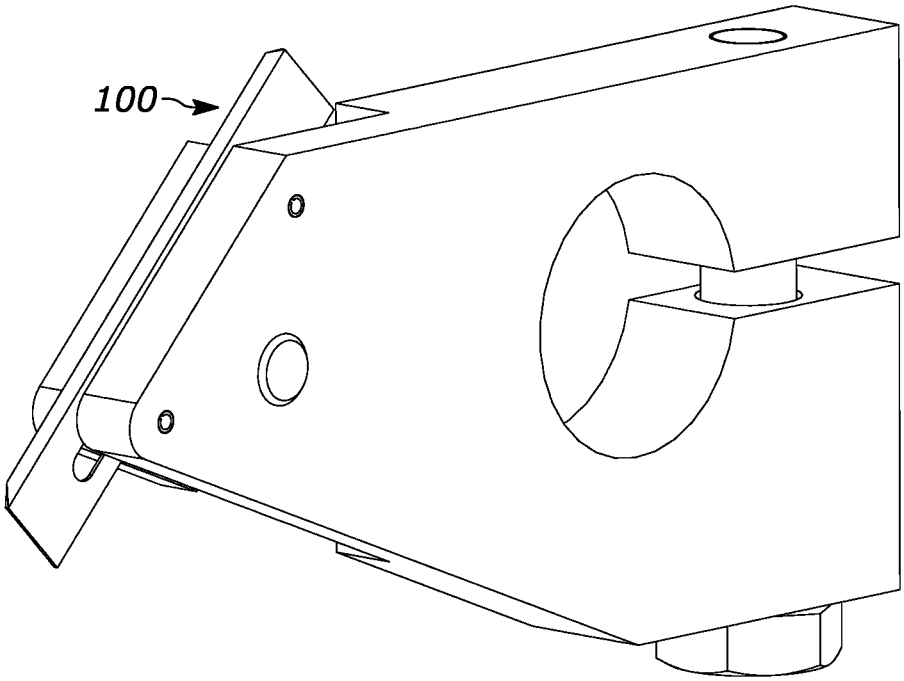
(PRIOR ART) FIGURE 2
FIG. 2 of the drawings is a back perspective view of a prior art razor blade holder assembly.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 3:
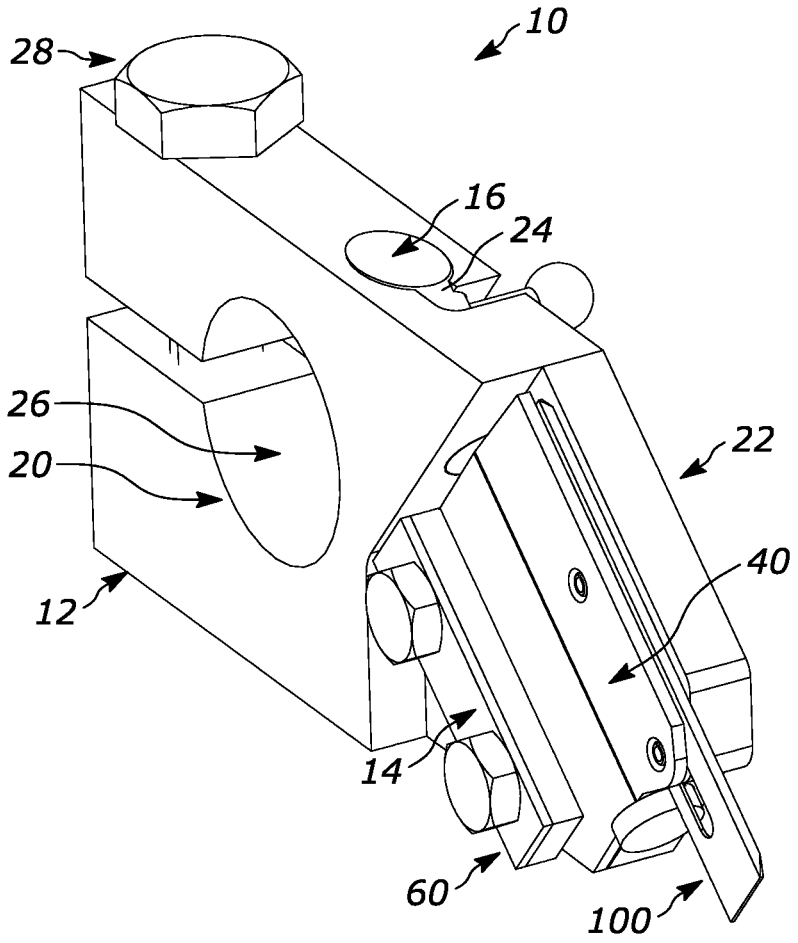
FIG. 3 of the drawings is a perspective view of the razor blade holder assembly of the present disclosure.
Figure 4:
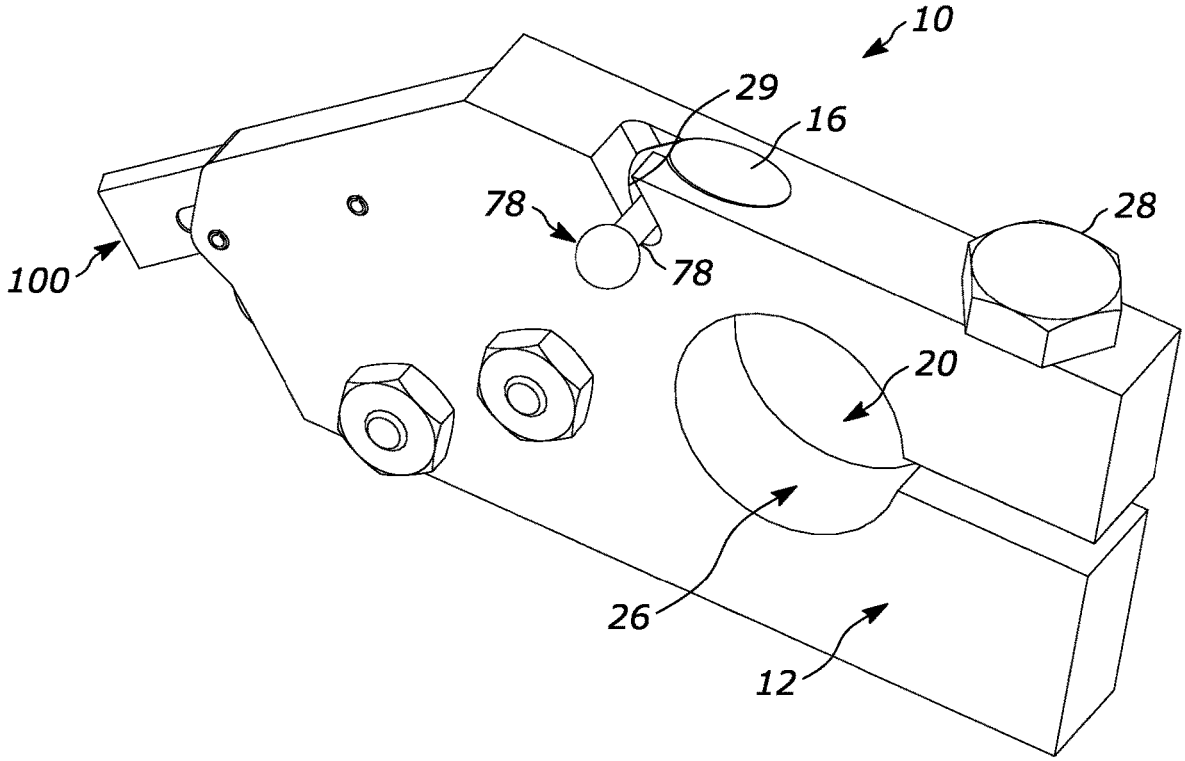
FIG. 4 of the drawings is a perspective view of the razor blade holder assembly of the present disclosure.
Figure 15:
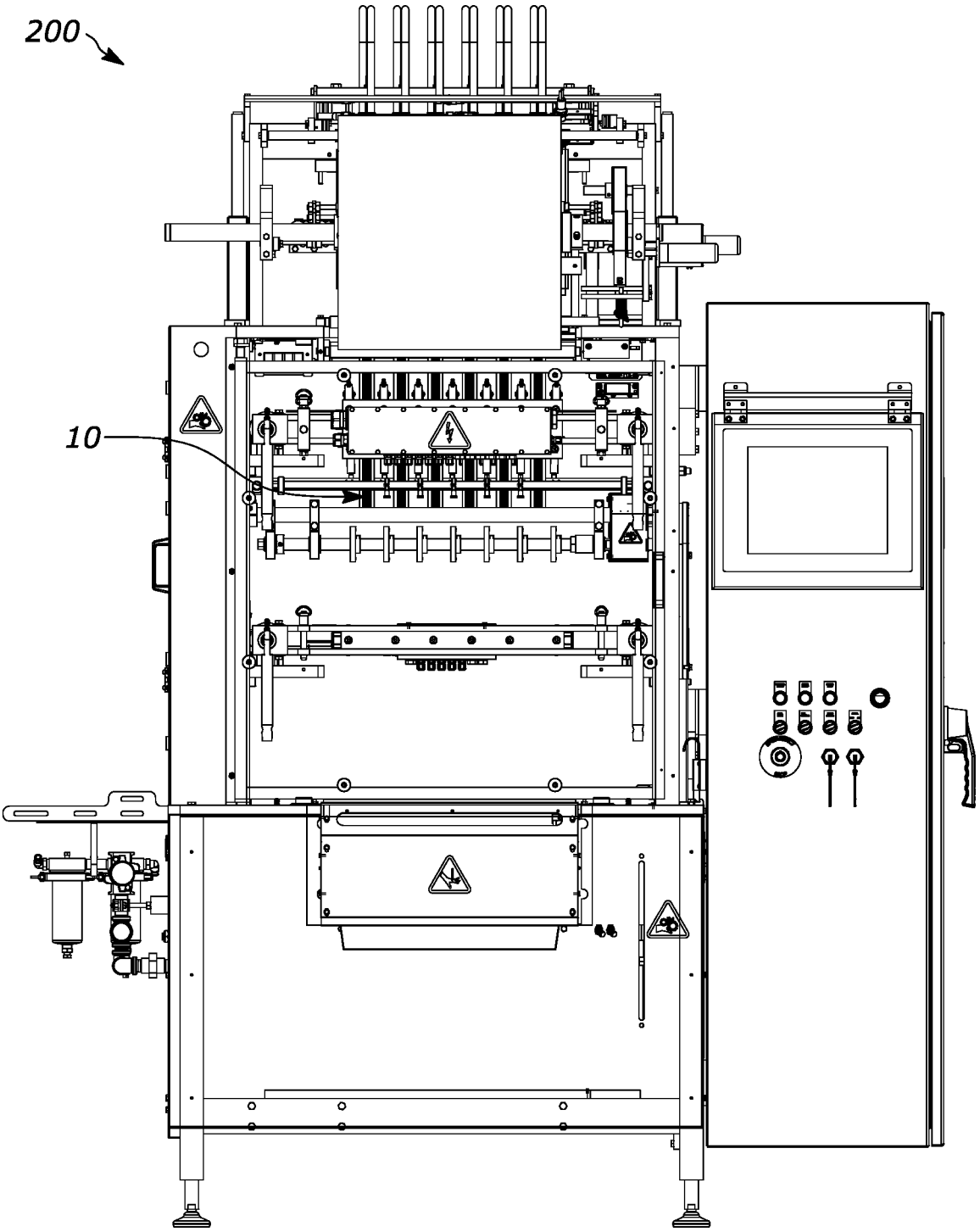
FIG. 15 of the drawings is a front elevational view of a pouch machine with which the razor blade holder of the present disclosure may be mounted upon.
Figure 16:
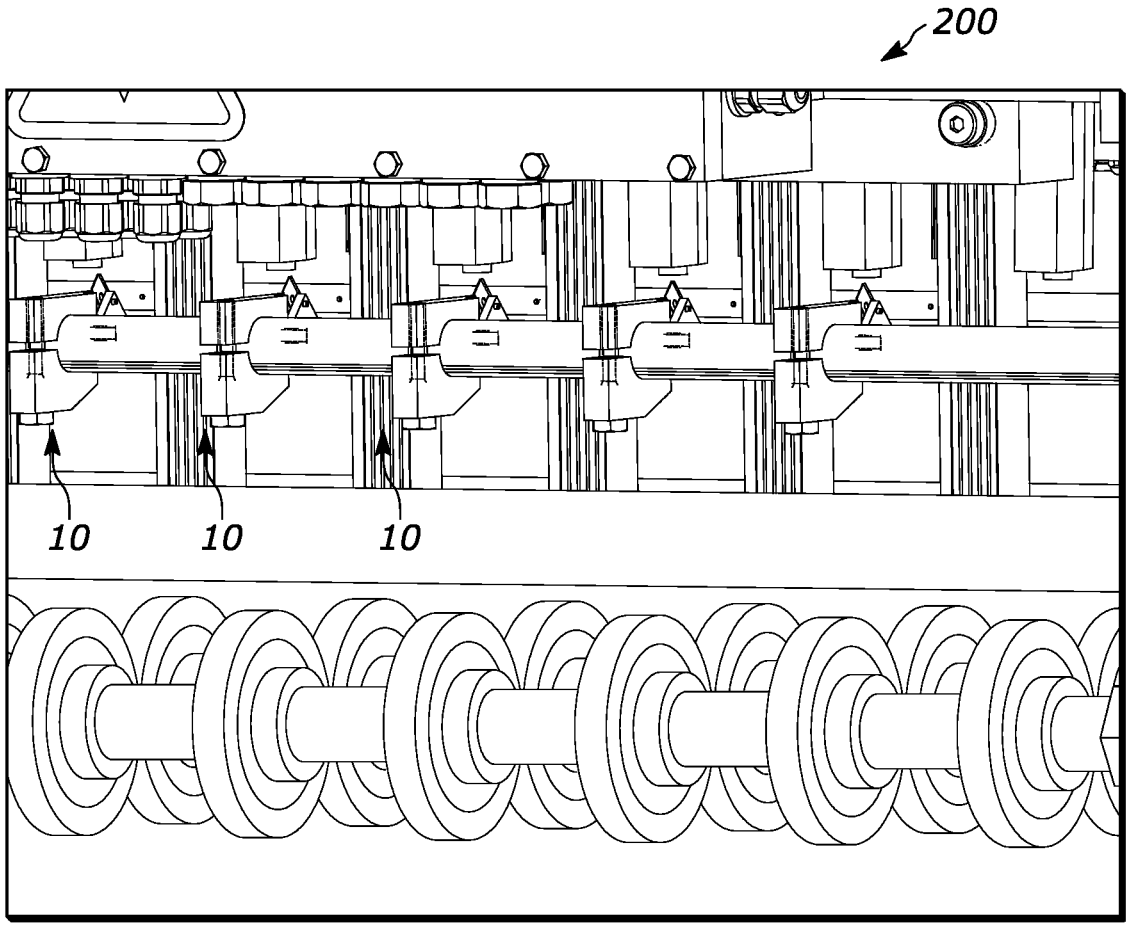
FIG. 16 of the drawings is a partial perspective view of a pouch machine having a plurality of razor blade holders associated therewith.

Referring now to the drawings and in particular to FIGS. 3 and 4, the razor blade holder assembly is shown generally at 10. The razor blade holder assembly is configured for use in association with a pouch machine (pouch making and/or filling), such as form fill seal machine, such as form fill seal machine 200 (shown in FIGS. 15 and 16) and is utilized for holding a razor blade that separating (i.e., cutting) adjoining rows of pouches that are progressing through the form fill seal member between adjacent vertical seals. For example, such a razor blade holder assembly is shown as being utilized in association with a pouch machine available from Winpak Lane, Inc. under the model number WP-18. The razor blade holder assembly is not limited to use therewith, or to any particular pouch making and/or filling machine, where streams of pouches are made in a side by side fashion, and the foregoing is for illustrative purposes.

Figure 10:
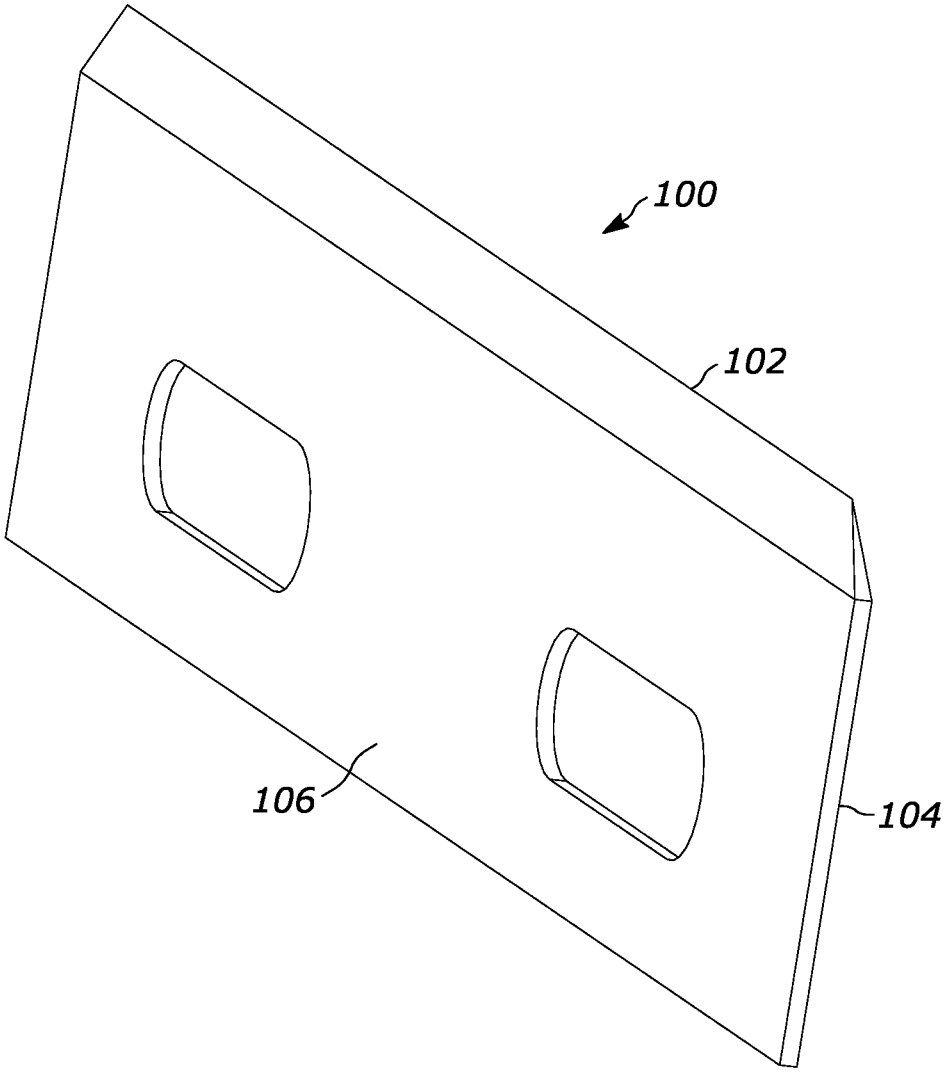
FIG. 10 of the drawings is a perspective view of a razor blade of the type associatable and attachable to the razor blade holder assembly.

The razor blade holder assembly includes body 12, movable jaw assembly 14 and adjustment member 16. The razor blade holder assembly is configured to releasably retain a razor blade such as razor blade 100. With reference to FIG. 10, the razor blade 100 includes cutting edge 102, first side 104 and second side 106. A plurality of either locating slots or notches along the edge may be defined in the razor blade.

Referring again to FIGS. 3 and 4, the body 12 of the razor blade holder assembly includes frame attachment 20, fixed jaws 22 and adjustor bore 24. The frame attachment 20 provides a manner by which to couple the body to the pouch machine. In the configuration shown, the pouch machine frame comprises a generally elongated cylinder, and, as such, the frame attachment comprises a bore having a channel extending therefrom to an edge of the body, with a fastener perpendicularly threadedly engaged with the body and extending through the channel between the bore and the edge of the body. It will be understood that through rotational movement of the fastener, the bore 26 can be clamped around the frame. Of course, other configurations by which to attach the body to the frame are contemplated, including other clamping structures, fasteners that directly couple the body to the frame, interference fits, slidable mating joints, among others.

Figure 5:
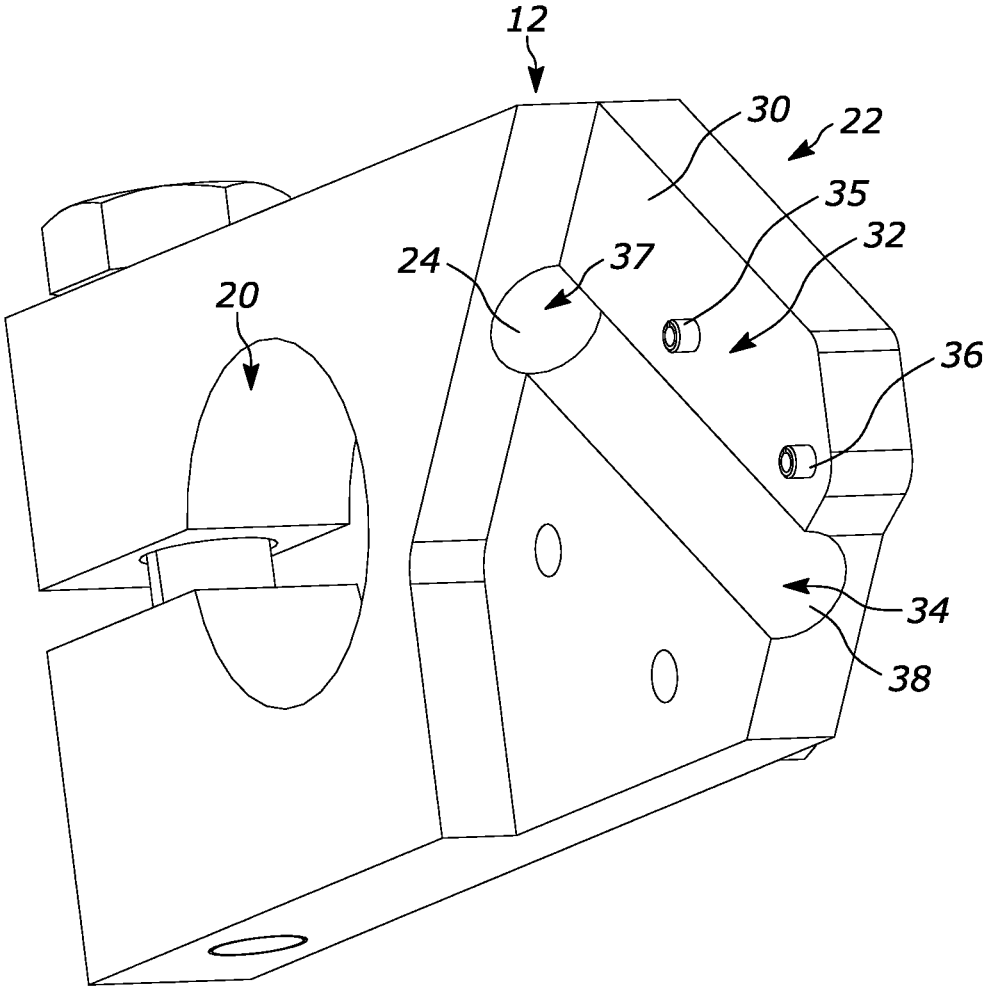
FIG. 5 of the drawings is a perspective view of the body of the razor blade holder assembly of the present disclosure, showing, in particular, the fixed jaw.
Figure 6:
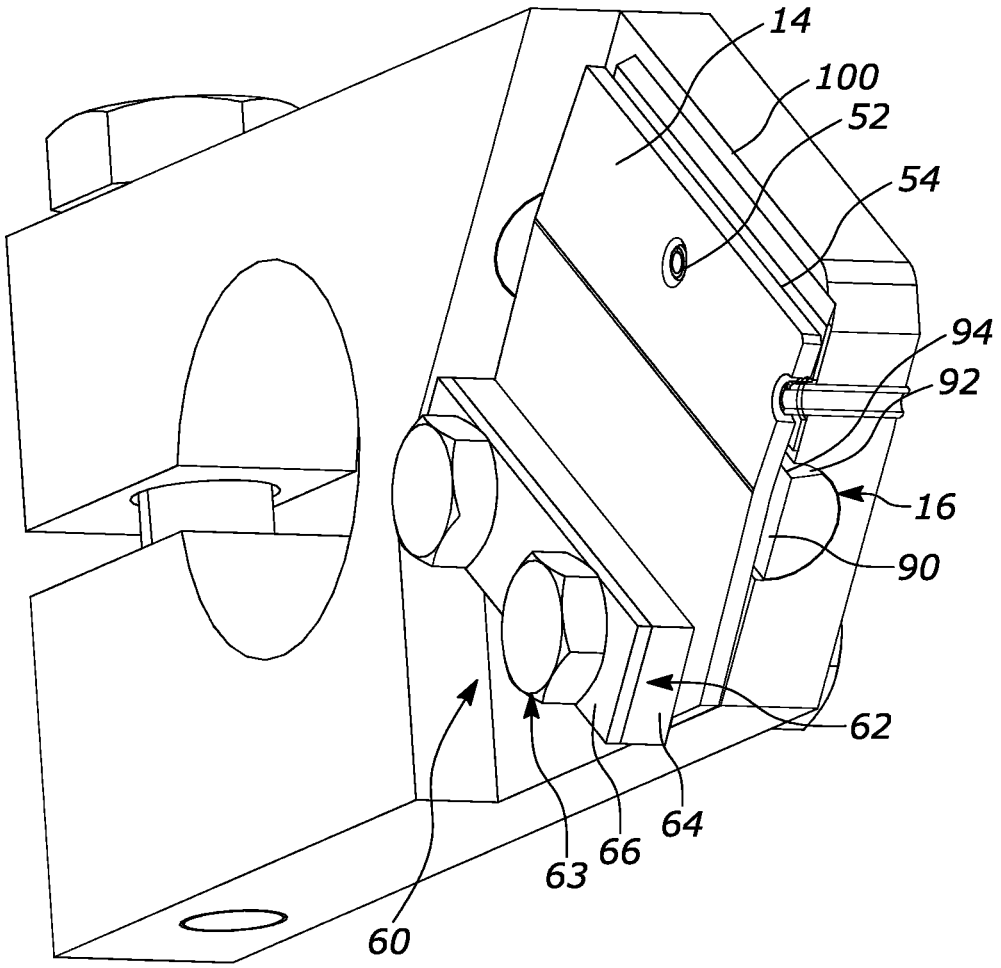
FIG. 6 of the drawings is a cross-sectional view of the razor blade holder assembly of the present disclosure.
Figure 7:
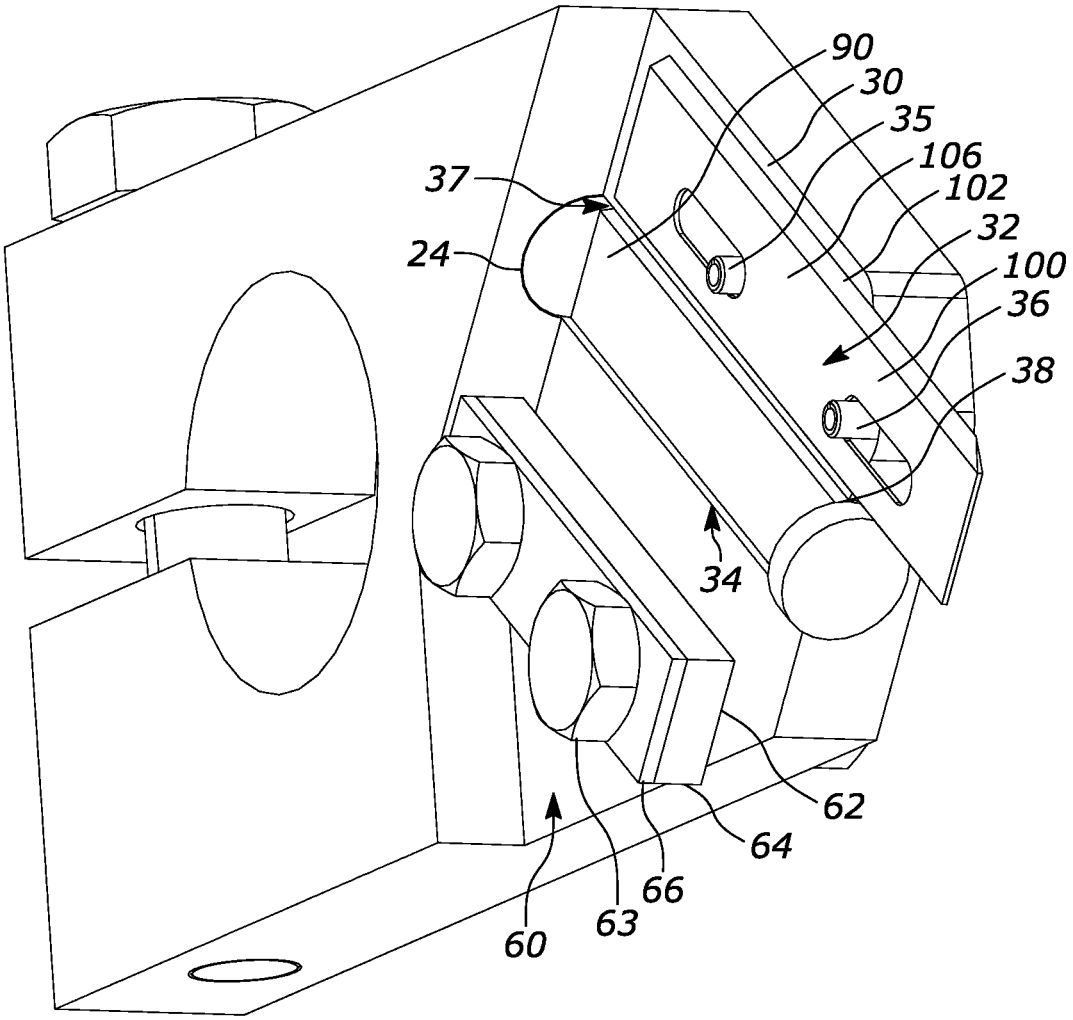
FIG. 7 of the drawings is a perspective view of the body of razor blade holder assembly of the present disclosure, with the plate member of the movable jaw assembly removed for clarity.
Figure 8:
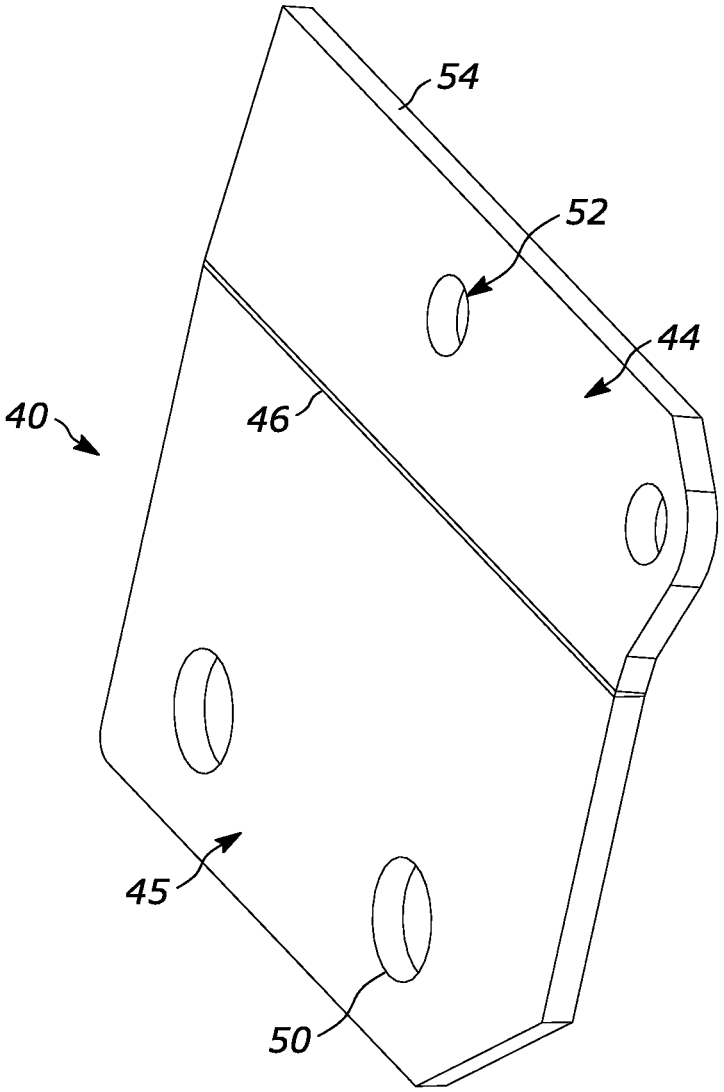
FIG. 8 of the drawings is a perspective view of the plate member of the present disclosure.
Figure 9:
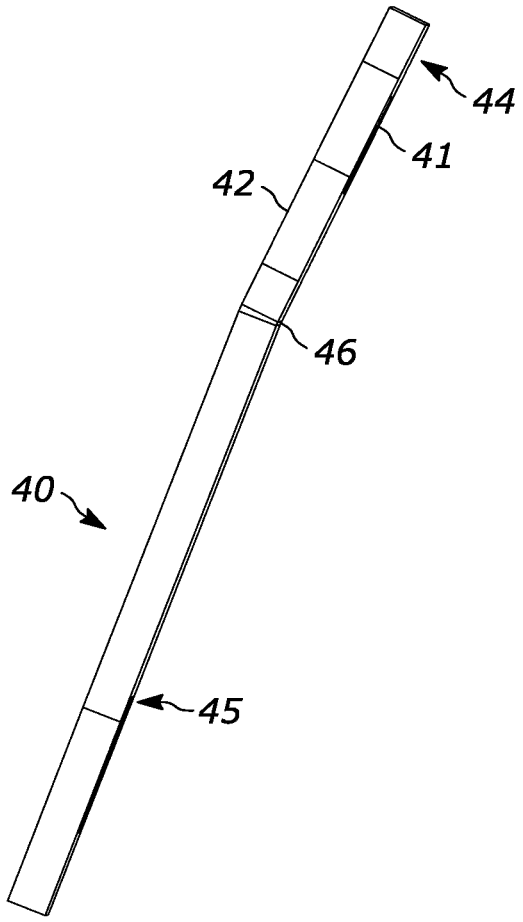
FIG. 9 of the drawings is a side elevational view of the plate member of the present disclosure.

With reference, additionally, to FIGS. 5 through 7, the fixed jaw 22 is formed as a part of the body 12. The fixed jaw defines a support face 30 onto which one side of the razor blade can be positioned (either directly or indirectly). In the configuration shown, the first side 104 of the razor blade 100 rests directly on the support face 30. The fixed jaw further includes blade interface 32 and adjustor channel 34. The blade interface 32, in the configuration shown, includes a first post 35 and a second post 36. The blade interface 32 facilitates the proper positioning of the razor blade 100 along the support face 30 in that, in the configuration shown, the posts extend through the slots (or engage the notches) defined within the razor blade to preclude slidable movement between the razor blade and the support face.

The adjustor channel 34 is a continuation of the adjustor bore 24 and extends along the length of the support face 30, preferably, without abuttingly engaging or underlying the portion of the support face over which the razor blade 100 is to sit. That is, and, as will be explained below, the adjustor channel provides a location for the adjustment member to be inserted to manipulate plate member 40 of the of the movable jaw assembly 14 to move the plate away so that the razor blade can be accessed so as to be, for example, removed and replaced. In the configuration shown, the channel has a semi-circular cross-sectional configuration, with the portion of the elongated rod portion substantially corresponding to such a configuration so that the elongated rod member can be rotated about axis of rotation 76 thereof. The operation will be described in greater detail below once the components and their relationships have been set forth in greater detail.

The adjustor bore 24 extends through the body so as to align with the adjustor channel 34. In the configuration shown, the adjustor bore has a substantially circular cross-section. And is imparted at an angle that substantially corresponds to the angle of the blade so that the cutting edge 102 of the razor blade 100 is substantially parallel to the axis of rotation of the adjustment member 16, and the adjustor bore 24. It is contemplated that the cross-sectional configurations may be other than substantially uniform circular and/or semi-circular configurations, and other shapes, such as conical, polygonal and the like are contemplated. The cross-sectional configuration allows for rotation of the device. In other configurations, keyed or other types of passageways may be utilized.

In configurations wherein the adjustment member is retained in position during operation, it is contemplated that the adjustor bore may further have a grasping or locking channel 29 (FIG. 4) which is configured to receive a handle or the like of the adjustment member.

The movable jaw assembly is shown in greater detail in FIGS. 6 through 9 as comprising plate member 40 and releasable securement subassembly 60. The plate member 40 includes inner surface 41, outer surface 42 opposite the inner surface. The plate member 40 further includes first portion 44 and second portion 45, which are angled relative to each other and meet at inflection 46 so that the inner surface is outwardly concave. The first portion 44, opposite the inflection 46 terminates at a distal edge 54. Preferably the distal edge 54 contacts the razor blade 100 at the second side 106 thereof so as to provide compressive force to maintain the position of the razor blade 100 against the support surface 30. It will be understood that in the configuration shown, at least a portion of the inner surface 41 of the plate member 40 interfaces one of directly or indirectly on the second side 106 of the razor blade 100. Additionally, the first portion includes fastener bores 50 that can receive the posts of the blade interface so as to anchor the posts and/or locate the posts relative to the plate member, and to further facilitate the maintenance of the relative positions of the plate member, the support face and the razor blade. The second portion includes openings to allow for the passage of fasteners 63 therethrough.

It is contemplated that the plate member may comprise a generally planar member, or another concave member, or a planar member that has an outwardly convex portion proximate the distal edge 54 so that when clamped, even if the plate member is disfigured, or deformed, a portion of the inner surface thereof is able to provide the necessary structure to sandwich the razor blade between the plate member and the support face.

In the configuration shown, this is accomplished by the first portion and the second portion of the plate members being substantially planar, but being disposed at an angle relative to each other so as to define an outwardly concave surface wherein the portions meet at the inflection 46. In another configuration, the inner surface of the plate member 40 may include a linear bump or a plurality of protrusions or bumps that interface with the second side 106 of the razor blade 100. Such protrusions may be at the distal edge or spaced apart from the distal edge. Additionally, such protrusions may be linear and parallel to the cutting edge 102, or may be more random or dispersed in orientations other than such a parallel arrangement. Such protrusions provide the necessary force transfer to retain the razor blade, and, may be operable even in the event that the plate member is undesirably deformed, for example.

The releasable securement subassembly 60 provides the necessary joining and clamping so that the plate member is capable of applying the necessary force against the razor blade to preclude movement therebetween and to retain the razor blade. At the same time, the releasable securement subassembly allows for the adjustment member to separate the plate member from the razor blade to allow for removal and replacement of the razor blade. In the configuration shown, the releasable securement subassembly 60 comprises biasing member 62 and fastener, such as fasteners 63, coupling the biasing member to the underlying body 12. In the configuration shown, the biasing member 62 comprises elastomer (although, as noted above, other biasing members, such as springs and the like are contemplated) 64 and plate member 66. The fasteners 63 extend through corresponding openings in each of the plate member 66, the elastomer 64 and the second portion 45 of the plate member 40 and the body 12. In the configuration shown, the fasteners comprise a nut and bolt arrangement, whereas in other configurations, the body, for example, may be threaded to eliminate the nut, or, the plate member and the fasteners may be unitized (with nuts opposite the body to retain the same).

As will be explained below, the biasing member (the elastomer in the configuration) does allow for pivoting of the plate member from engagement with the razor blade 100 through manipulation of the adjustment member, while providing the necessary biasing force to direct the plate member with sufficient force to maintain the razor blade in the desired deployed and retained configuration. At the same time, the plate member 66 provides protection for the elastomer so as to minimize stress concentrations proximate the openings and the fasteners. In other configurations, the biasing member may comprise, for example a spring, or plurality of springs such as leaf springs, compression springs, helical springs, among others.

Figure 11:
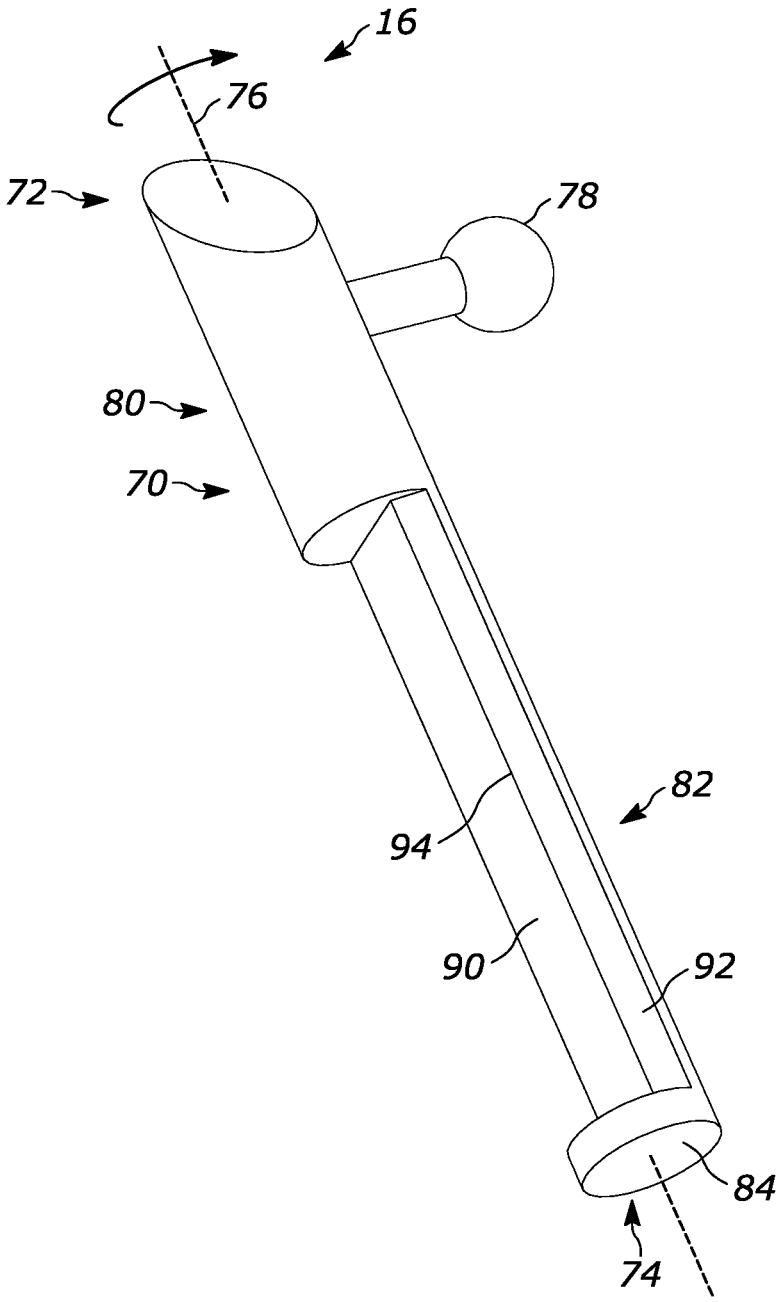
FIG. 11 of the drawings is a perspective view of the adjustment member of the razor blade holder assembly of the present disclosure.
Figure 12:
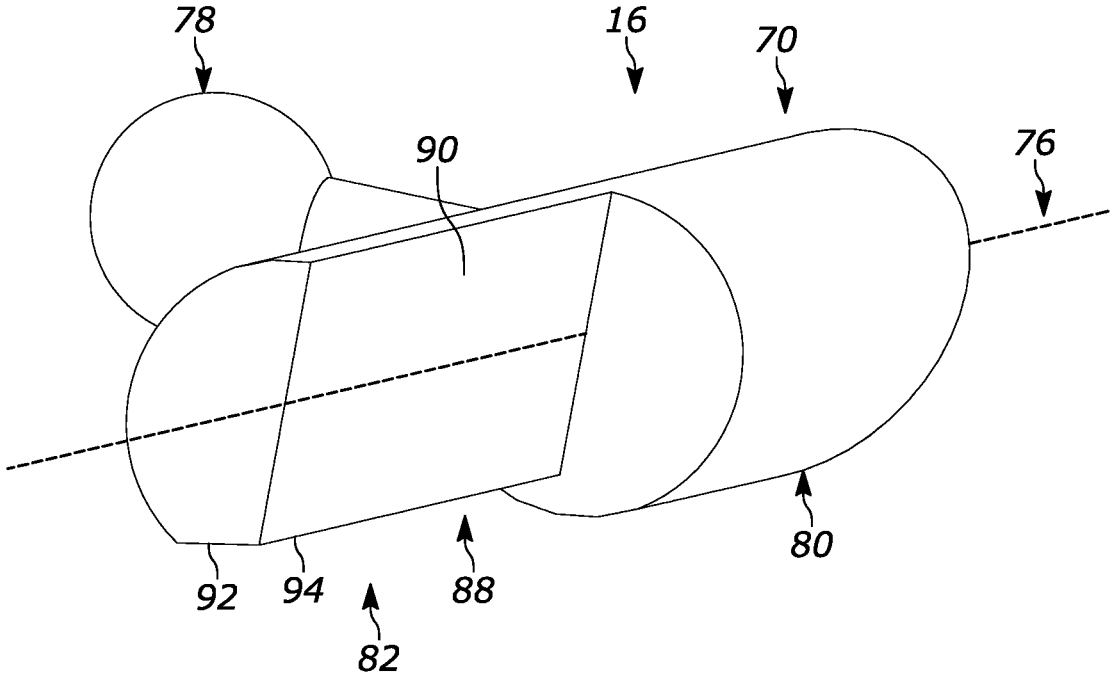
FIG. 12 of the drawings is a cross-sectional view of the adjustment member of the razor blade holder assembly of the present disclosure.

The adjustment member 16 is shown in FIGS. 7, 11 and 12 as comprising elongated rod member 70. The elongated rod member 70 may be of the type that remains within the bore and the channel during operation. Such an elongated rod member extends from first end 72 to second end 74. The elongated rod member essentially extends through the adjustor bore 24 and the adjustor channel 34, and in the configuration shown, extends through the adjustor channel beyond the second end thereof. In other configurations, it is contemplated that the elongated rod member may extend only partially along the adjustor channel and that the second end 74 may remain within the adjustor channel between the first end 37 and second end 38 thereof.

Further, the elongated rod member may include handle 78 which facilitates the rotation of the elongated rod member when in the operable position, rotation about the axis of rotation 76. In the configuration shown, the handle 78 is configured to be stowed within the grasping channel 29 when the jaws are in the clamped configuration (or, in other configurations, when in the unclamped configuration). In other configurations, the handle 78 can remain outside of the body 12.

The elongated rod member 70 includes bore engagement portion 80, channel engagement portion 82 and end cap portion 84. The bore engagement portion 80, in the configuration corresponds to the adjustor bore 24 to facilitate rotation of the elongated rod member about the axis of rotation 76 thereof. In the configuration shown, the bore engagement portion has a circular cross-section that substantially corresponds to the cross-sectional configuration of the adjuster bore such that the bore engagement portion can rotate therewithin without substantial binding or the like. The relative sizing can be varied to have the appropriate amount of rotation and movement therebetween.

The channel engagement portion 82 is shown as comprising the jaw interfacing surface which includes a clamped facing surface 90, an open facing surface 92 and a forcing surface 94. The clamped facing surface 90 generally interfaces, engages, abuts and/or faces the plate member when the movable jaw assembly is in the clamped configuration. The open facing surface 92 interfaces, engages, abuts and/or faces the plate member when the movable jaw assembly is in the open or unclamped configuration. The forcing surface 94 generally initiates the transition between the clamped and the unclamped configurations. Additional surfaces may be defined in addition to the foregoing surfaces.

In the configuration shown, the clamped facing surface generally comprises a planar surface that extends across a diameter or cord of the elongated rod member, to, define the semi-circular cross-sectional configuration. Generally, and in the configuration shown, the clamped facing surface is positioned at or below the support face 30 so as to be within the adjustor channel. In some configurations, the surface may abut or otherwise engage with the inner surface of the plate member 40. In other configurations, the two may be facing but may only contact at the edges upon rotation of the elongated rod member relative to the plate member 40 and the body 12.

At the other end, in the open configuration, the open facing surface engages with the inner surface 41 of the plate member 40 to maintain a separation between the inner surface of the plate member and the second side of the razor blade so that the razor blade can be removed from between the fixed jaw and the plate member of the movable jaw. In the configuration shown, the separation is generally equal to the diameter (or thickness) of the elongated rod member at the open facing surface minus the depth of the adjustor channel 34. Also, in the configuration shown, the clamped facing surface and the open facing surface are generally orthogonal to each other. In the configuration shown, they both comprise substantially planar surfaces, while other configurations are contemplated, including points or lines or segments of contact.

The forcing surface 94 is defined by the intersection and/or a region between the clamped facing surface and the open facing surface. As will be explained below, the forcing surface, which, in the configuration shown, comprises a line that extends generally parallel to the axis of rotation spaced apart from the axis of rotation, engages the inner surface of the plate member to initiate separation of the plate member from the fixed jaw, which separation will eventually free the razor blade from being sandwiched and clamped. The forcing surface initiates the movement of the plate member and forms the transition between the clamped facing surface and the open facing surface.

It is contemplated that additional surfaces may be present between the clamped facing surface and the open facing surface, to achieve different patterns of separation of the plate member from the support face of the fixed jaw, however, essentially, rotation of the elongated rod member achieves movement of the plate member relative to the support face of the fixed jaw to achieve access, removal and replacement of the razor blade 100. In some configurations, only the forcing surface may contact the plate member (directly or indirectly) to direct the plate member and to overcome the biasing member to separate the plate member from the support face.

The end cap portion 84, in the configuration shown comprises a configuration that is substantially similar in cross-section to the bore engagement portion. Of course, other configurations are contemplated. The end cap portion 84 defines a flange which interfaces with the plate member to preclude removal of the elongated rod member from within the adjustor channel and the adjustor bore.

Figure 13:
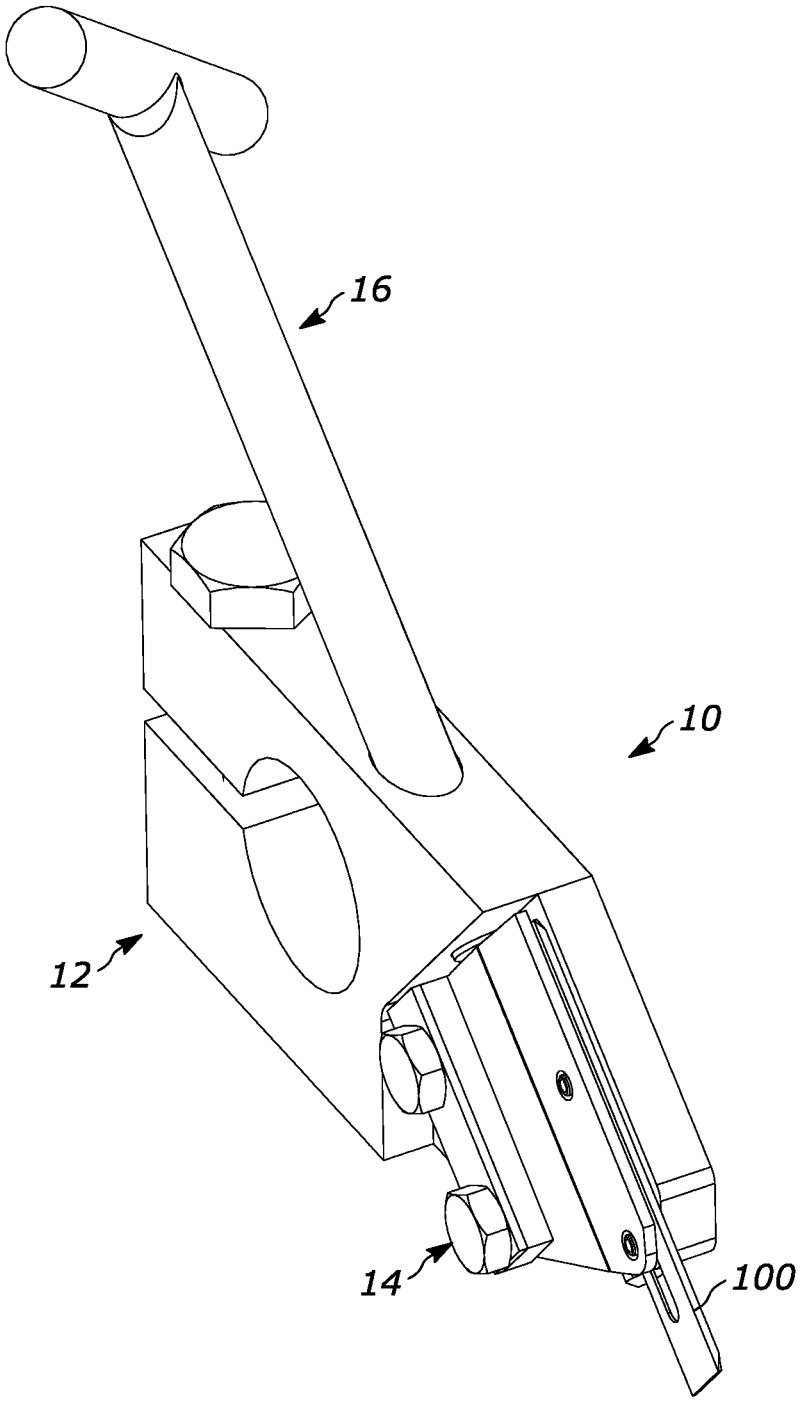
FIG. 13 of the drawings is a perspective view of another razor blade holder assembly, showing, in particular, a removable adjustment member.
Figure 14:
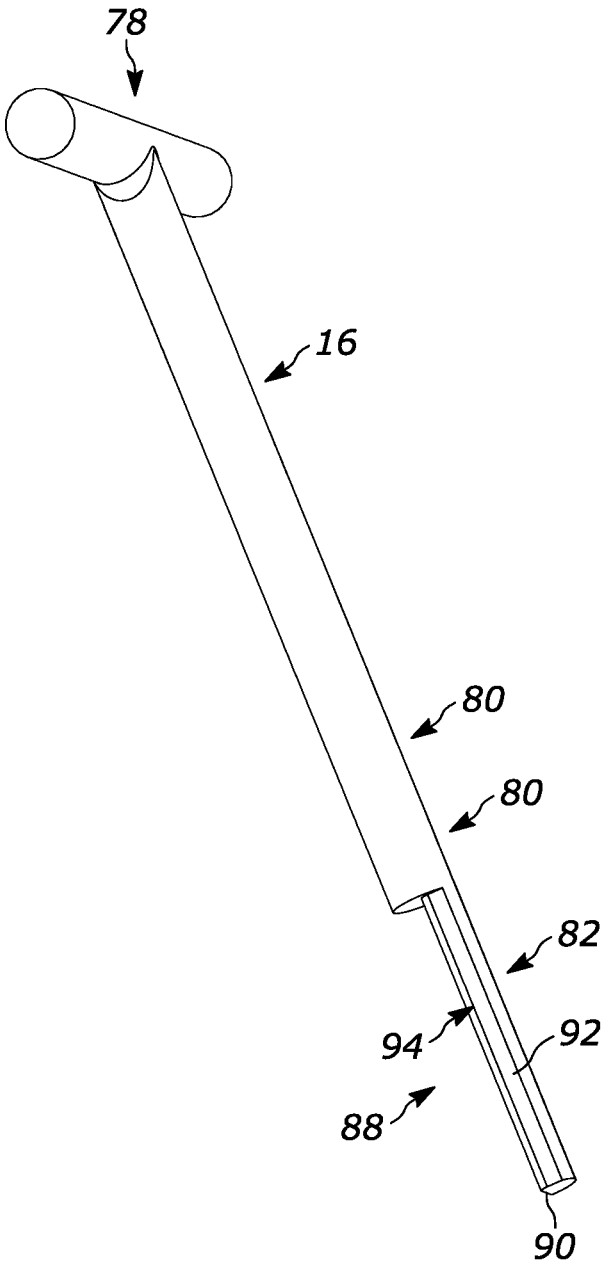
FIG. 14 of the drawings is a perspective view of a removable adjustment member utilized with a razor blade holder assembly of the present disclosure.

It will be understood that in the embodiment shown, the elongated rod member remains coupled throughout the operation of the razor blade, as well as during removal and replacement. In other configurations, such as the configuration of FIGS. 13 and 14, the adjustment member may comprise a tool that is utilized only during removal and replacement of the razor blade, and otherwise is removed from the razor blade holder assembly and stowed.

In operation, it will be understood that a number of the razor blade holder assemblies can be present on a pouch machine, or other type of machine. In the exemplary pouch machine of FIG. 1, a total of five razor blade holder assemblies are provided, each clamped to the frame thereof in a spaced apart orientation. As will be understood, the frame is passed through the bore 26 of the frame attachment 20 and the fastener 28 is tightened to clamp the frame within the bore 26. It will be understood that the fastener can be loosened to allow for the translation of the body along the frame to the desired position and rotational orientation. When the desired orientation is reached, the fastener can be retightened to clamp the structures together.

Either prior to initial attachment of the assembly to the frame of the pouch machine, or after, a razor blade may be installed in the razor blade holder assembly. To achieve the same, the movable jaw assembly and the fixed jaw are separated to provide placement or removal of the razor blade. Starting with a configuration such as shown in FIG. 3, the elongated rod member is rotated, for example, buy grasping the handle 78 of the elongated rod member and rotating the rod along the axis of rotation 76 thereof. Initially, the clamped facing surface 90 is facing the inner surface of the plate member. As the elongated rod member is rotated, eventually, the forcing surface 94 contacts the inner surface of the plate member. Continued rotation of the elongated rod member applies a force through the forcing surface 94 onto the inner surface of the plate member thereby overcoming the biasing force of the biasing member 62 and begins to rotate and/or translate the plate member away from the support face of the fixed jaw. Continued movement further separates the plate member from the support face of the fixed jaw. Eventually, the plate member is moved so that the posts of the blade interface exit the corresponding openings and are spaced apart from the plate member. Eventually, through rotation, the forcing surface passes beyond the plate member and the plate member comes to rest on the opening facing surface. At such time, the further rotation can be stopped and the plate member will remain in the open configuration.

In the configuration shown, the handle member likewise reaches a rotational end of travel and is stopped by the body surrounding the adjustor bore 24.

At such time, the razor blade 100 can be introduced. The razor blade 100 is positioned so that the posts extend through corresponding slots to locate the razor blade. Once located, the razor blade is directed toward the support face 30 of the fixed jaw. Notably, a portion of a distal end of the cueing edge 102 extends beyond the footprint of the support face and the body member when installed, while at least portions of the cutting edge remain within the footprint of the support face.

Once the razor blade is positioned in the operable position, the elongated rod member can be rotated in the opposite direction so as to initially dislodge the inner surface of the plate member from the open facing surface onto the forcing surface and then, subsequently out of contact from the plate member and/or onto the clamped facing surface. It will be understood that as the elongated rod member is rotated back to an initial position, the biasing member directs the plate member toward the support face, and, eventually the distal edge 54 comes into direct or indirect contact with the second side of the razor blade. Continued rotation further forces the plate member (with increasing force by the biasing member) toward the razor blade. Eventually, the elongated rod member is no longer applying much of, if any, force against the biasing member, and the razor blade is sandwiched between the plate member and the support face and releasably maintained in such a position.

The blade is now ready for use. Over time, it may be necessary to remove and replace the blade (i.e., after damage to the blade, wear, etc.). To replace the razor blade, a similar process is undertaken. Specifically, the elongated rod member is again rotated so as to force and direct the separation of the plate member from the support face. Eventually, the plate member is separated sufficiently to allow for the grasping and removal of the razor blade from between the plate member and the support face. The razor blade can be removed and replaced. In much the opposite manner, the elongated rod member can be rotated in the opposite direction to facilitate reengagement of the plate member with the support face to clamp the razor blade therebetween.

Where the elongated rod member comprises a releasably coupled tool, the rod member may be slid back out of the adjustor channel and the adjustor bore and decoupled from the body 12.

Advantageously, the removal and replacement of the razor blades does not require wrenches, sockets or other tools that engage and disconnect fasteners. Instead, simple rotation of an elongated rod member which remains coupled to the body, or which is releasably coupled to the body facilitates the separation of the jaws and removal and replacement of the razor blade.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A razor blade holder assembly comprising:

a body having a frame attachment and a fixed jaw, the fixed jaw having a support face and an adjustor channel extending thereacross;

a movable jaw assembly including:

a plate member having an inner surface placeable over the adjustor channel and the support face; and a releasable securement subassembly coupling the plate member to the body, the releasable securement subassembly including a biasing member that applies a biasing force against the plate member, biasing the plate member toward the support face; and an adjustment member including an elongated rod member rotatably positionable within the adjustor channel, the elongated rod member having a forcing surface selectively rotatable into the plate member to, in turn, overcome the biasing member to direct the plate member away from the support face;

wherein in a clamped configuration of the razor blade holder assembly, the plate member is directed into the support face to be structurally configured to clamp a razor blade therebetween and wherein in an open configuration of the razor blade holder assembly, the forcing surface of the elongated rod member overcomes the biasing member to separate the plate member from the support face to be structurally configured to facilitate the removal of the razor blade therebetween.

2. The razor blade holder assembly of claim 1 wherein the body further includes an adjustor bore aligned with the adjustor channel, through which the elongated rod member can be directed.

3. The razor blade holder assembly of claim 1 wherein the adjustor channel is substantially parallel to a cutting edge of a razor blade.

4. The razor blade holder assembly of claim 1 wherein the fixed jaw further includes a blade interface extending from the surface thereof, the blade interface structurally configured to interact with the razor blade to position the razor blade in a desired orientation on the support face.

5. The razor blade holder assembly of claim 4 wherein the blade interface comprises at least one post extending from the support face.

6. The razor blade holder assembly of claim 1 wherein the plate member includes a first portion and a second portion, the first and second portions being angled relative to each other to form an outwardly concave configuration, with the first portion having a distal edge structurally configured to overlie the razor blade and the support face and to impart a force thereagainst.

7. The razor blade holder assembly of claim 6 wherein the biasing member comprises an elastomer that overlies an outer surface of the plate member over the second portion of the plate member, with a fastener that couples the elastomer and the plate member to the body, with the elastomer and the body sandwiching the plate member therebetween.

8. The razor blade holder assembly of claim 7 wherein the adjustor channel is positioned between the distal edge of the movable jaw assembly and the biasing member.

9. The razor blade holder assembly of claim 1 wherein the plate member includes a first portion and a second portion, the first portion having an inner surface directable toward the support face, to, in turn, retain a razor blade therebetween.

10. The razor blade holder assembly of claim 1 wherein the elongated rod member further includes a clamped facing surface and an open facing surface, with the clamped facing surface facing the plate member when in a clamped configuration, and with the open facing surface facing the plate member when in the open configuration, and with the forcing surface being positioned rotationally between the clamped facing surface and the open facing surface.

11. The razor blade holder assembly of claim 1 wherein the elongated rod member is rotatable about an axis of rotation between a clamped configuration and an open configuration.

12. The razor blade holder assembly of claim 1 wherein the elongated rod member further includes a handle member to facilitate the rotation thereof, with at least a portion of the handle member stowable within a grasping channel in the body when the elongated rod member is in the clamped configuration.

13. The razor blade holder assembly of claim 12 wherein the elongated rod member is releasably attachable to the body and removable when rotated into a clamped configuration.

14. The razor blade holder assembly of claim 1 wherein the elongated rod member includes an end cap portion interfaceable with the plate member when in the clamped configuration, to, in turn, preclude slidable removal of the elongated rod member from within the adjustor channel.

15. A combination of a razor blade holder assembly and a razor blade, the combination including:

a body having a frame attachment and a fixed jaw, the fixed jaw having a support face and an adjustor channel extending thereacross;

a movable jaw assembly including:

a plate member having an inner surface placeable over the adjustor channel and the support face; and a releasable securement subassembly coupling the plate member to the body, the securement subassembly including a biasing member that applies a biasing force against the plate member, biasing the plate member toward the support face; and an adjustment member including an elongated rod member rotatably positionable within the adjustor channel, the elongated rod member having a forcing surface selectively rotatable into the plate member to, in turn, overcome the biasing member to direct the plate member away from the support face;

the razor blade having a first side and a second side, and a cutting edge, the first side of the razor blade positioned over the support face;

wherein in a clamped configuration of the razor blade holder assembly, the plate member is directed into the support face to be structurally configured to impart force against the second side of the razor blade to clamp the razor blade therebetween and wherein in an open configuration of the razor blade holder assembly, the forcing surface of the elongated rod member overcomes the biasing member to separate the plate member from the support face to be structurally configured to facilitate the removal of the razor blade therebetween.

16. The combination of claim 15 wherein a portion of the cutting edge of the razor blade extends beyond the footprint of the support face.

17. The combination of claim 16 wherein a portion of the cutting edge of the razor blade remains within the footprint of the support face.

18. A pouch machine having a frame with at least one razor blade holder assembly coupled thereto retaining a razor blade, comprising:

a body having a frame attachment and a fixed jaw, the fixed jaw having a support face and an adjustor channel extending thereacross;

a movable jaw assembly including:

a plate member having an inner surface placeable over the adjustor channel and the support face; and a releasable securement subassembly coupling the plate member to the body, the securement subassembly including a biasing member that applies a biasing force against the plate member, biasing the plate member toward the support face; and an adjustment member including an elongated rod member rotatably positionable within the adjustor channel, the elongated rod member having a forcing surface selectively rotatable into the plate member to, in turn, overcome the biasing member to direct the plate member away from the support face;

the razor blade having a first side and a second side, and a cutting edge, the first side of the razor blade positioned over the support face;

wherein in a clamped configuration, the plate member is directed into the support face to be structurally configured to impart force against the second side of the razor blade clamp the razor blade therebetween and wherein in an open configuration, the forcing surface of the elongated rod member overcomes the biasing member to separate the plate member from the support face to be structurally configured to facilitate the removal of the razor blade therebetween.

* * * * *